US007025490B1

(12) United States Patent
Tseng

(10) Patent No.: US 7,025,490 B1
(45) Date of Patent: Apr. 11, 2006

(54) ERROR-PROOF MOUNTING ASSEMBLY FOR TWINKLE LIGHT SET TO PREVENT MOUNTING OF A LIGHT BULB HOLDER INTO AN INCORRECT SOCKET

(76) Inventor: Wei-Jen Tseng, 5F, No. 10, Lane 23, Tungshan St., Hsinchu (TW)

( * ) Notice: Subject to any disclaimer, the term of this patent is extended or adjusted under 35 U.S.C. 154(b) by 0 days.

(21) Appl. No.: 10/988,826

(22) Filed: Nov. 15, 2004

(51) Int. Cl.
*H01R 33/00* (2006.01)

(52) U.S. Cl. ..... 362/654; 362/653; 362/655; 362/659; 439/699.2

(58) Field of Classification Search ..... 313/318.01; 362/652–655, 657–659; 439/699.1, 699.2
See application file for complete search history.

(56) References Cited

U.S. PATENT DOCUMENTS 6,452,317 B1 * 9/2002 Tseng ..... 362/653

* cited by examiner

*Primary Examiner*—Stephen F Husar
(74) *Attorney, Agent, or Firm*—Jackson Walker, LLP

(57) ABSTRACT

A mounting assembly includes first long and short legs on a first light bulb holder to correspond to first long and short recesses in the first socket, a first sectorial periphery in an outer periphery of the first light bulb holder to correspond to the first arcuate periphery on the first socket and a first right angle on the first light bulb holder to correspond to the first angle on the first socket. Further provisions are second long and short legs on a second light bulb holder to correspond to second long and short recesses in the second socket, a second sectorial periphery in an outer periphery of the second light bulb holder to correspond to the second arcuate periphery on the second socket and a first right angle on the second light bulb holder to correspond to the second angle on the second socket.

2 Claims, 5 Drawing Sheets

ERROR-PROOF MOUNTING ASSEMBLY FOR TWINKLE LIGHT SET TO PREVENT MOUNTING OF A LIGHT BULB HOLDER INTO AN INCORRECT SOCKET

BACKGROUND OF THE INVENTION

1. Field of the Invention

The present invention relates to an error-proof mounting assembly, and more particularly to an error-proof mounting assembly for twinkle light set to prevent mounting of a light bulb holder into an incorrect socket.

2. Description of Related Art

U.S. Pat. No. 6,474,841 discussing a twinkle light set discloses a concept of a standard light bulb and a non-standard light bulb adjacent to the standard light bulb. In brief, the twinkle light set has multiple standard light bulbs alternately mounted on the light set and multiple non-standard light bulbs alternately mounted on the light set such that each standard light bulb is sandwiched between two non-standard light bulbs. With the interior and exterior differences between the standard light bulb and the non-standard light bulb, the standard light bulb and the non-standard light bulb are not interchangeably mounted on the light set. The concept introduced by this patent is very helpful in the design of the configuration of the light bulb assembly.

To overcome the shortcomings, the present invention tends to provide an improved error-proof mounting assembly for the twinkle light set to mitigate problems of incorrect mounting of light bulbs.

SUMMARY OF THE INVENTION

The primary objective of the present invention is to provide an improved error-proof mounting assembly to allow only the correct light bulb holder to be mounted in the correct socket.

Other objects, advantages and novel features of the invention will become more apparent from the following detailed description when taken in conjunction with the accompanying drawings.

DETAILED DESCRIPTION OF THE PREFERRED EMBODIMENT

Figure 1:
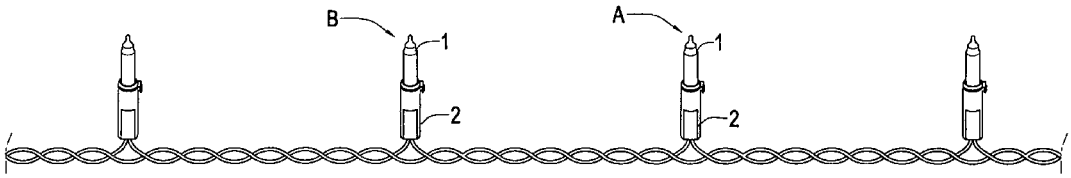
FIG. 1 is perspective view showing the appearance of the twinkle light set of the present invention.
Figure 2:
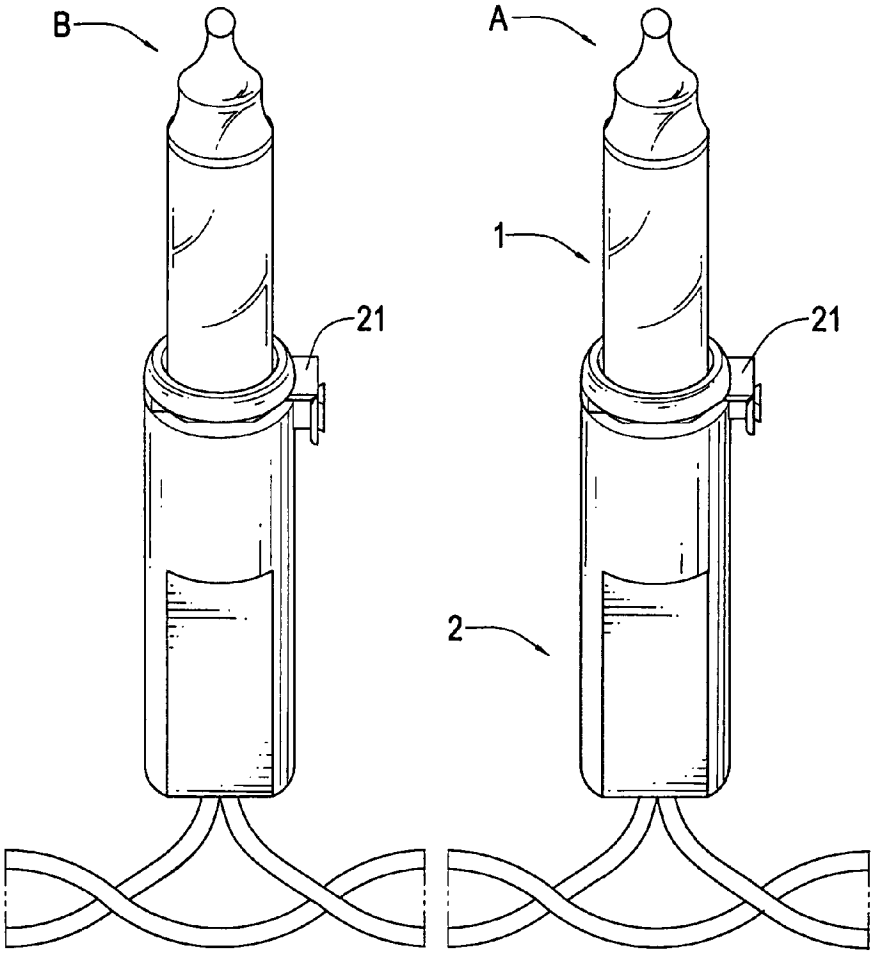
FIG. 2 is a perspective view showing two adjacent light assemblies.

With reference to FIGS. 1 and 2, the twinkle light set in question has multiple light assemblies mounted on a power line. Each light assembly has a light bulb holder (1) and a socket (2). The light bulb holder (1) has a light bulb therein and an ear (11) formed on a peripheral edge of the light bulb holder (1). The socket (2) has a projection (21) formed on a peripheral edge of the socket (2).

Figure 3:
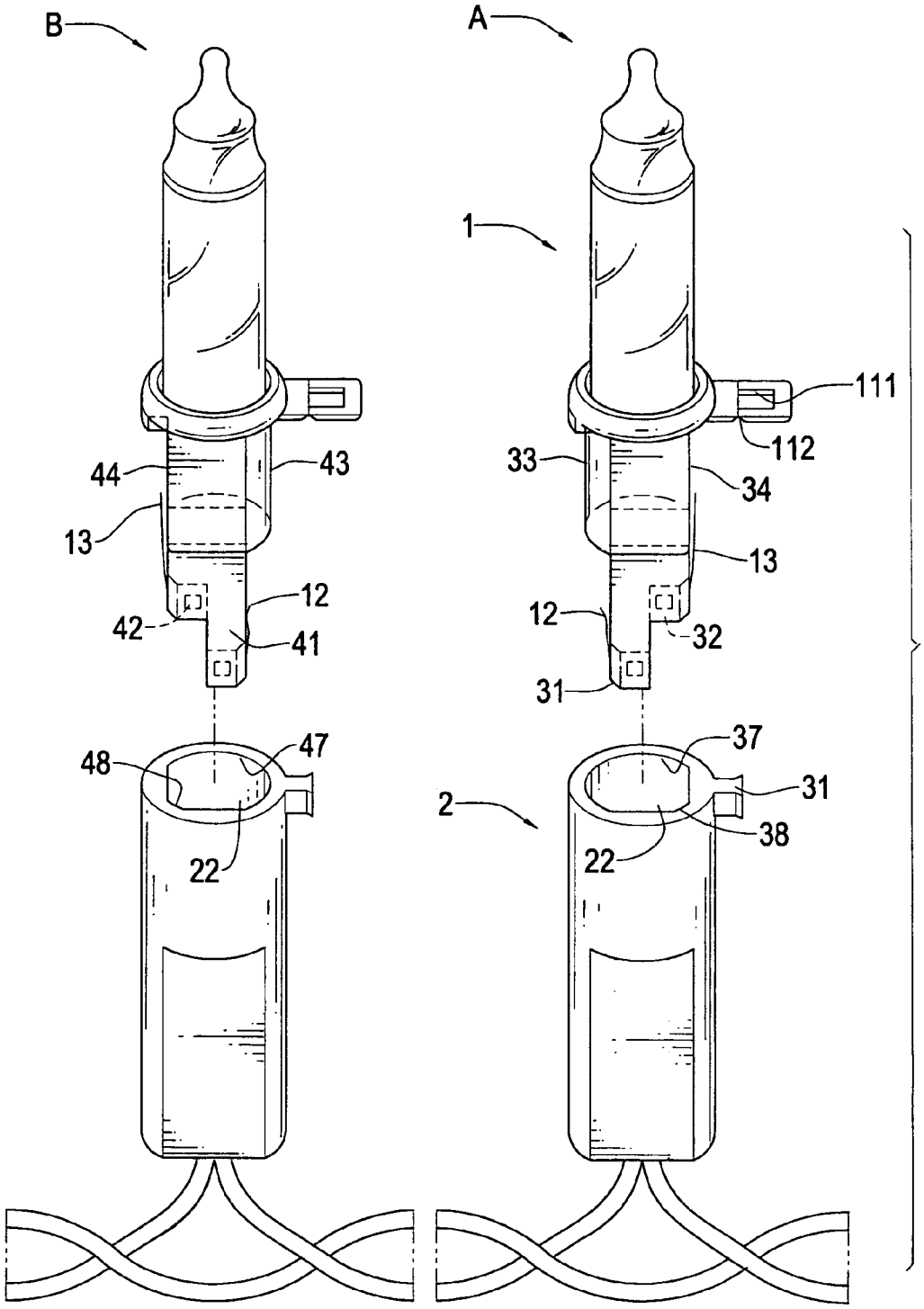
FIG. 3 is an exploded perspective view showing the two adjacent light assemblies of the present invention.

With reference to FIG. 3, it is noted that the ear (11) has a through hole (111) defined through the ear (11) and a groove (112) defined in a bottom face of the ear (11). Therefore, after the light bulb holder (1) is partially received in a room (22) defined in a central portion of the socket (2), a bent of the ear (11) along the groove (112) secures the combination between the light bulb holder (1) and the socket (2). The combination between the light bulb holder (1) and the socket (2) is quite conventional in the art, further detailed description thereof is thus omitted.

Figure 4:
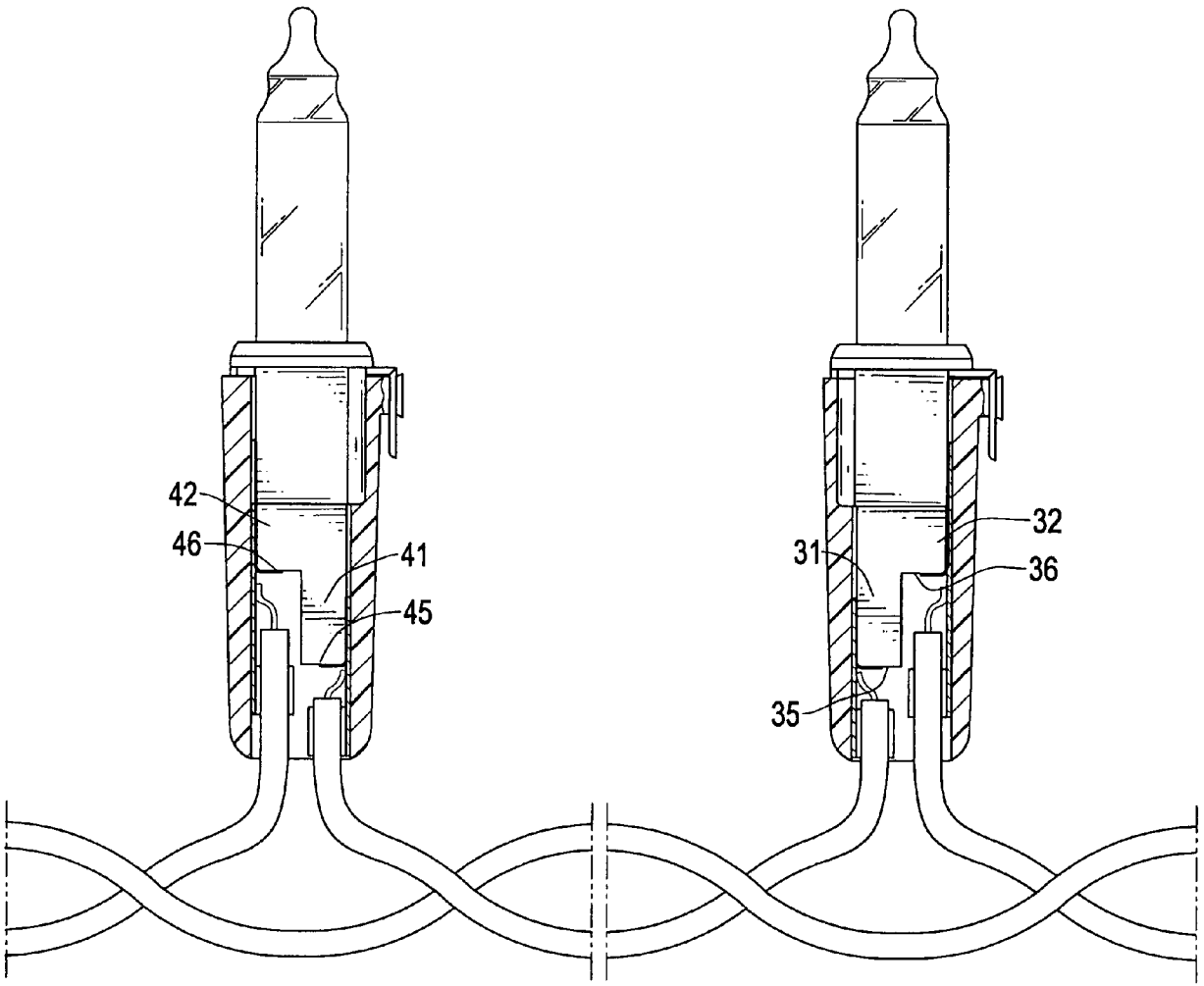
FIG. 4 is a schematic cross sectional view showing the combination of the two adjacent light assemblies.

With reference to FIG. 4 and taking FIG. 3 in conjunction, the error-proof mounting assembly in accordance with the present invention is mounted on two adjacent light assemblies (A,B). The light assembly (A) has a first long leg (31) extending outward from a bottom face of the light bulb holder (1), a first short leg (32) extending outward from the bottom face of the light bulb holder (1), a first sectorial periphery (33) formed on an outer periphery of the light bulb holder (1) and a first right angle (34) formed on the outer periphery of the light bulb holder (1), wherein two wires (12,13) extending from the light bulb respectively extend from the first long and short legs (31,32). Further, the socket (2) has a first long recess (35) defined in a bottom face defining the room (22) to correspond to the first long leg (31), a first shallow recess (36) defined in the bottom face defining the room (22) to correspond to the first short leg (32), a first arcuate periphery (37) formed on a side face of the room (22) to correspond to the first sectorial periphery (33) and a first angle (38) defined in the side face of the room (22) to correspond to the first right angle (34).

The light assembly (B) has a second long leg (41) extending outward from a bottom face of the light bulb holder (1), a second short leg (42) extending outward from the bottom face of the light bulb holder (1), a second sectorial periphery (43) formed on an outer periphery of the light bulb holder (1) and a second right angle (44) formed on the outer periphery of the light bulb holder (1), wherein two wires (12,13) extending from the light bulb respectively extend from the second long and short legs (41,42). Further, the socket (2) has a second long recess (45) defined in a bottom face defining the room (22) to correspond to the second long leg (41), a second shallow recess (46) defined in the bottom face defining the room (22) to correspond to the second short leg (42), a second arcuate periphery (47) formed on a side face of the room (22) to correspond to the second sectorial periphery (43) and a second angle (48) defined in the side face of the room (22) to correspond to the second right angle (44).

From the drawing of FIG. 3, it is noted that the first long and short legs (31,32) and the second long and short legs (41,42) are opposite to each other. The first long and shallow recesses (35,36) corresponding to the first long and short legs (41,42) are opposite to the second long and shallow recesses (45,46). Furthermore, the first sectorial periphery (33) is opposite to the second sectorial periphery (43) and the first right angle (34) is opposite to the second right angle (44).

With the opposite configuration of the two adjacent light assemblies, there is no room left for incorrect mounting the light bulb holder (1) of the light assembly (A) in the socket (2) of the light assembly (B) such that correct mounting of the light bulb holder (1) in the corresponding socket (2) is reassured.

Figure 5:
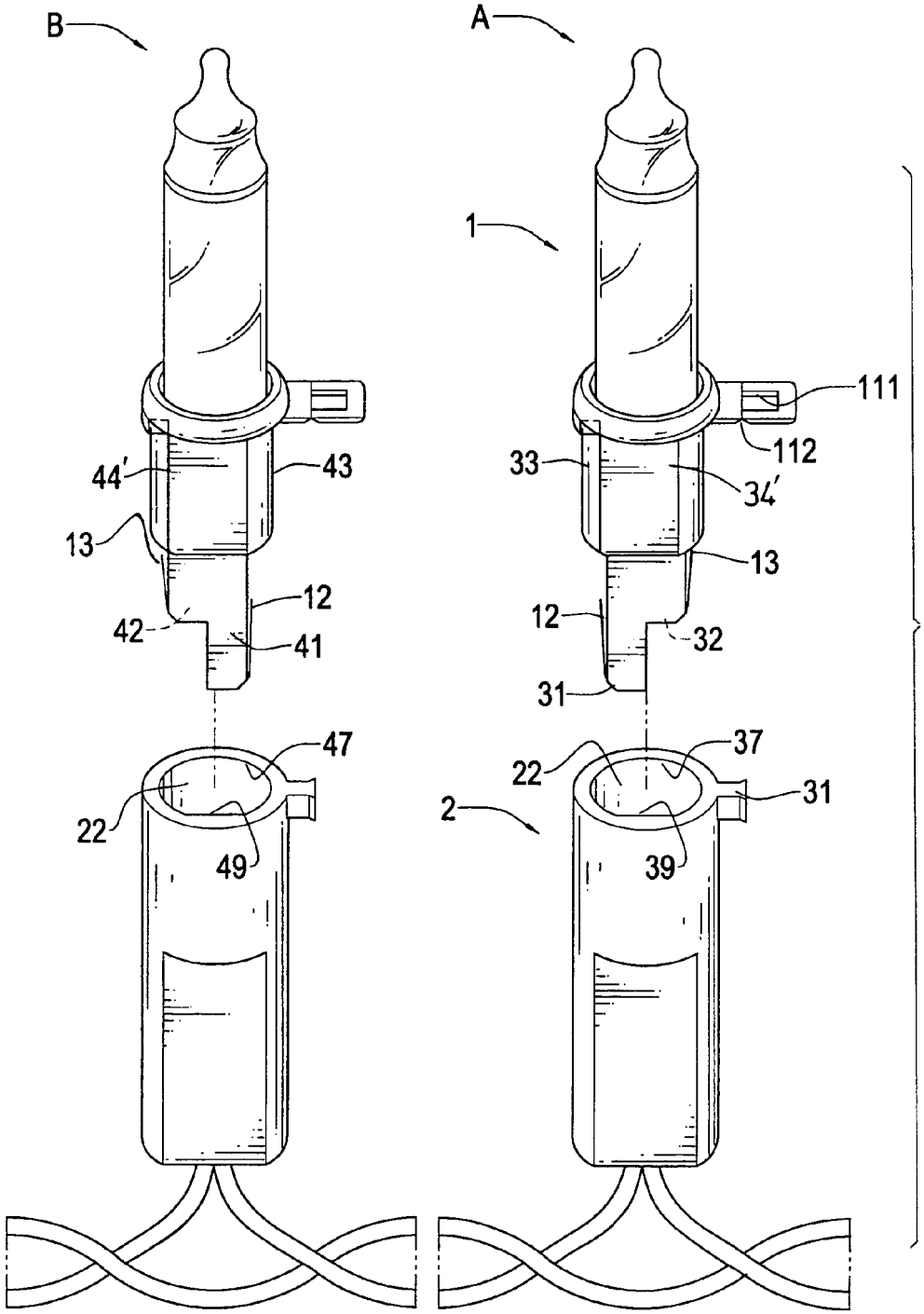
FIG. 5 is an exploded perspective view showing the two adjacent light assemblies of the present invention in a different embodiment.

With reference to FIG. 5, it is noted that the embodiment of the present invention may use only the first sectorial periphery (33) adapted to be formed on an outer periphery of the first light bulb holder and a first plane (34') adapted to be formed on the outer periphery of the first light bulb holder. Furthermore, the socket (2) has a second first straight line (39) formed with the first arcuate periphery (37) to correspond to the first plane (34') of the bulb holder. The light assembly (B) may use only the second sectorial periphery (43) and a second plane (44') formed with the second sectorial periphery (43). Further, the socket (2) of the light assembly (B) may have only the second arcuate periphery (47) and a second straight line (49) formed with the second arcuate periphery (47) to correspond to the second plane (44').

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mounting assembly for a first light assembly and a second light assembly adjacent to the first light assembly, each having a light bulb holder and a socket with a room to partially receive therein the light bulb holder on a twinkle light set, the mounting assembly comprising:

a first mounting device having:

a first long leg adapted to extend outward from a bottom face of a first light bulb holder;

a first short leg adapted to extend outward from the bottom face of the first light bulb holder;

a first sectorial periphery adapted to be formed on an outer periphery of the first light bulb holder;

a first right angle adapted to be formed on the outer periphery of the first light bulb holder;

a first long recess adapted to be defined in a bottom face defining the first room to correspond to the first long leg;

a first shallow recess adapted to defined in the bottom face defining the first room to correspond to the first short leg;

a first arcuate periphery adapted to be formed on a side face of the first room to correspond to the first sectorial periphery; and a first angle adapted to be defined in the side face of the first room to correspond to the first right angle, a second mounting device having:

a second long leg adapted to extend outward from a bottom face of the second light bulb holder;

a second short leg adapted to extend outward from the bottom face of the second light bulb holder;

a second sectorial periphery adapted to be formed on an outer periphery of the second light bulb holder;

a second right angle adapted to be formed on the outer periphery of the second light bulb holder;

a second long recess adapted to be defined in a bottom face defining the second room to correspond to the second long leg;

a second shallow recess adapted to be defined in the bottom face defining the second room to correspond to the second short leg;

a second arcuate periphery adapted to be formed on a side face of the second room to correspond to the second sectorial periphery; and a second angle adapted to be defined in the side face of the second room to correspond to the second right angle.

2. A mounting assembly for a first light assembly and a second light assembly adjacent to the first light assembly, each having a light bulb holder and a socket with a room to partially receive therein the light bulb holder on a twinkle light set, the mounting assembly comprising:

a first mounting device having:

a first long leg adapted to extend outward from a bottom face of a first light bulb holder;

a first short leg adapted to extend outward from the bottom face of the first light bulb holder;

a first sectorial periphery adapted to be formed on an outer periphery of the first light bulb holder;

a first plane adapted to be formed on the outer periphery of the first light bulb holder;

a first long recess adapted to be defined in a bottom face defining the first room to correspond to the first long leg;

a first shallow recess adapted to defined in the bottom face defining the first room to correspond to the first short leg;

a first arcuate periphery adapted to be formed on a side face of the first room to correspond to the first sectorial periphery; and a first straight line adapted to be defined in the side face of the first room to correspond to the first plane, a second mounting device having:

a second long leg adapted to extend outward from a bottom face of the second light bulb holder;

a second short leg adapted to extend outward from the bottom face of the second light bulb holder;

a second sectorial periphery adapted to be formed on an outer periphery of the second light bulb holder;

a second plane adapted to be formed on the outer periphery of the second light bulb holder;

a second long recess adapted to be defined in a bottom face defining the second room to correspond to the second long leg;

a second shallow recess adapted to be defined in the bottom face defining the second room to correspond to the second short leg;

a second arcuate periphery adapted to be formed on a side face of the second room to correspond to the second sectorial periphery; and a second straight line adapted to be defined in the side face of the second room to correspond to the second plane.

* * * * *